US006149138A

United States Patent [19]

Birdsell

[11] Patent Number: 6,149,138

[45] Date of Patent: Nov. 21, 2000

[54] PORTABLE HUMIDIFIER WITH KEYED REPLACEABLE CARTRIDGE ELEMENT

[75] Inventor: Walter Birdsell, Marlborough, Mass.

[73] Assignee: Honeywell, Inc., Minneapolis, Minn.

[21] Appl. No.: 09/238,239

[22] Filed: Jan. 27, 1999

[51] Int. Cl.[7] ..... B01F 3/04

[52] U.S. Cl. ..... 261/30; 261/99; 261/107; 261/DIG. 41

[58] Field of Search ..... 261/30, 72.1, 94, 261/99, 107, DIG. 41

[56] References Cited

U.S. PATENT DOCUMENTS

| | | | |
|---|---|---|---|
| 209,076 | 10/1878 | Reznor | 261/99 |
| 583,126 | 5/1897 | Ryder | 261/99 |
| 1,470,156 | 10/1923 | Evan | 261/99 |
| 2,307,938 | 1/1943 | Mathias | 261/99 |
| 2,552,887 | 5/1951 | Demonet et al. | 261/99 |
| 3,355,155 | 11/1967 | Heltzen et al. | 261/99 |
| 3,497,188 | 2/1970 | McDuffee | 261/99 |
| 3,914,349 | 10/1975 | Stipanuk | 261/DIG. 41 |
| 4,443,386 | 4/1984 | Wrightson | 261/DIG. 41 |
| 5,399,073 | 3/1995 | Bauer | 261/99 |
| 5,478,506 | 12/1995 | Lavimodiere | 261/72.1 |
| 5,540,867 | 7/1996 | Debello | 261/DIG. 41 |

*Primary Examiner*—C. Scott Bushey
*Attorney, Agent, or Firm*—John E. Toupal; Harold G. Jarcho

[57] ABSTRACT

A portable humidifier including a housing defining an air inlet, an air outlet, and an air flow path therebetween; a retainer disposed in the housing and defining key structure; and an air permeable, liquid absorbent cartridge element replaceably retained by the retainer and defining keyhole structure shaped and arranged to receive the key structure and at least one portion of the cartridge element being disposed in the air flow path. Also included is a blower disposed in the housing and activatable to produce air flow through the air flow path and cartridge element and a liquid supply for supplying liquid to the portion of the cartridge element.

12 Claims, 4 Drawing Sheets

PORTABLE HUMIDIFIER WITH KEYED REPLACEABLE CARTRIDGE ELEMENT

BACKGROUND OF THE INVENTION

The invention relates generally to an evaporative humidifier device, and, more particularly, to an evaporator device utilizing a liquid absorbing element to provide humidification.

Evaporator devices are used extensively to enhance personal comfort by increasing the level of humidity in an enclosed environment. They can function additionally to provide cooling in many hot, dry regions. One well known type of evaporative humidifier employs liquid absorbing wick elements that produce by capillary action liquid flow from a reservoir to wick portions disposed in a path of airflow provided by an electrical blower. Operating efficiency of such humidifiers is somewhat dependent on the air permeability and liquid absorbency and wicking characteristics of the wick element employed. Consequently, efficiency often is impaired unintentionally by replacement of a wick element having optimized characteristics with one less effective.

The object of this invention, therefore, is to provide a portable humidifier in which the use of improper wick elements is prevented.

SUMMARY OF THE INVENTION

The invention is a portable humidifier including a housing defining an air inlet, an air outlet, and an air flow path therebetween; a retainer disposed in the housing and defining key structure; and an air permeable, liquid absorbent cartridge element replaceably retained by the retainer and defining keyhole structure shaped and arranged to receive the key structure and at least one portion of the cartridge element being disposed in the air flow path. Also included is a blower disposed in the housing and activatable to produce air flow through the air flow path and cartridge element and a liquid supply for supplying liquid to the portion of the cartridge element, The mated key and keyhole structures prevent use in the humidifier of an improper cartridge element.

According to one feature of the invention, the key structure defines projections and the keyhole structure defines recesses shaped and arranged to receive the projections. The projections and recesses establish the desired keying arrangement between the humidifier and the cartridge element.

According to another feature of the invention, the projections include a plurality of spaced apart projections; the recesses include a plurality of recesses, each disposed to receive one of said projections; and the projections and recesses each are spaced apart in an asymmetrical array. Desired keying is provided by the asymmetrical arrays.

According to a further feature of the invention, the keyhole structure includes a plurality of parallel sleeves embedded in the cartridge element and defining the recesses; and the projections are substantially vertical fingers projecting into the housing. The parallel sleeves and fingers facilitate separation of the humidifier and cartridge element.

According to still another feature of the invention, each of the sleeves extends substantially vertically into the cartridge element and has at one end a collar portion engaging an outer surface thereof. The collars simplify assembly of the cartridge element and the vertical sleeves facilitate its insertion and removal.

According to yet another feature of the invention, the liquid supply is a liquid reservoir defined by the housing and another portion of the cartridge element is disposed in the reservoir. The arrangement efficiently provides liquid migration from the reservoir to the another cartridge element portion by capillary action.

The invention also encompasses a replaceable air permeable, liquid absorbent cartridge element for use in a portable humidifier having a key structure defining a retainer for receiving the cartridge element; and wherein the cartridge element defines keyhole structure shaped and arranged, to receive the key structure. The key and keyhole structures insure use of proper cartridge elements in the humidifier.

According to one feature of the cartridge element, the keyhole structure defines a plurality of recesses for receiving the key structure and spaced apart in an asymmetrical array. Desired keying is provided by the asymmetrical sleeve array.

According to other features of the cartridge element, each of the recesses is formed by an embedded sleeve and the sleeves are substantially parallel. The parallel sleeves facilitate cartridge element replacement for the humidifier.

According to yet another feature of the cartridge element, each sleeve has at one end a collar engaging an outer surface of the cartridge element. The collars facilitate assembly of the cartridge element.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
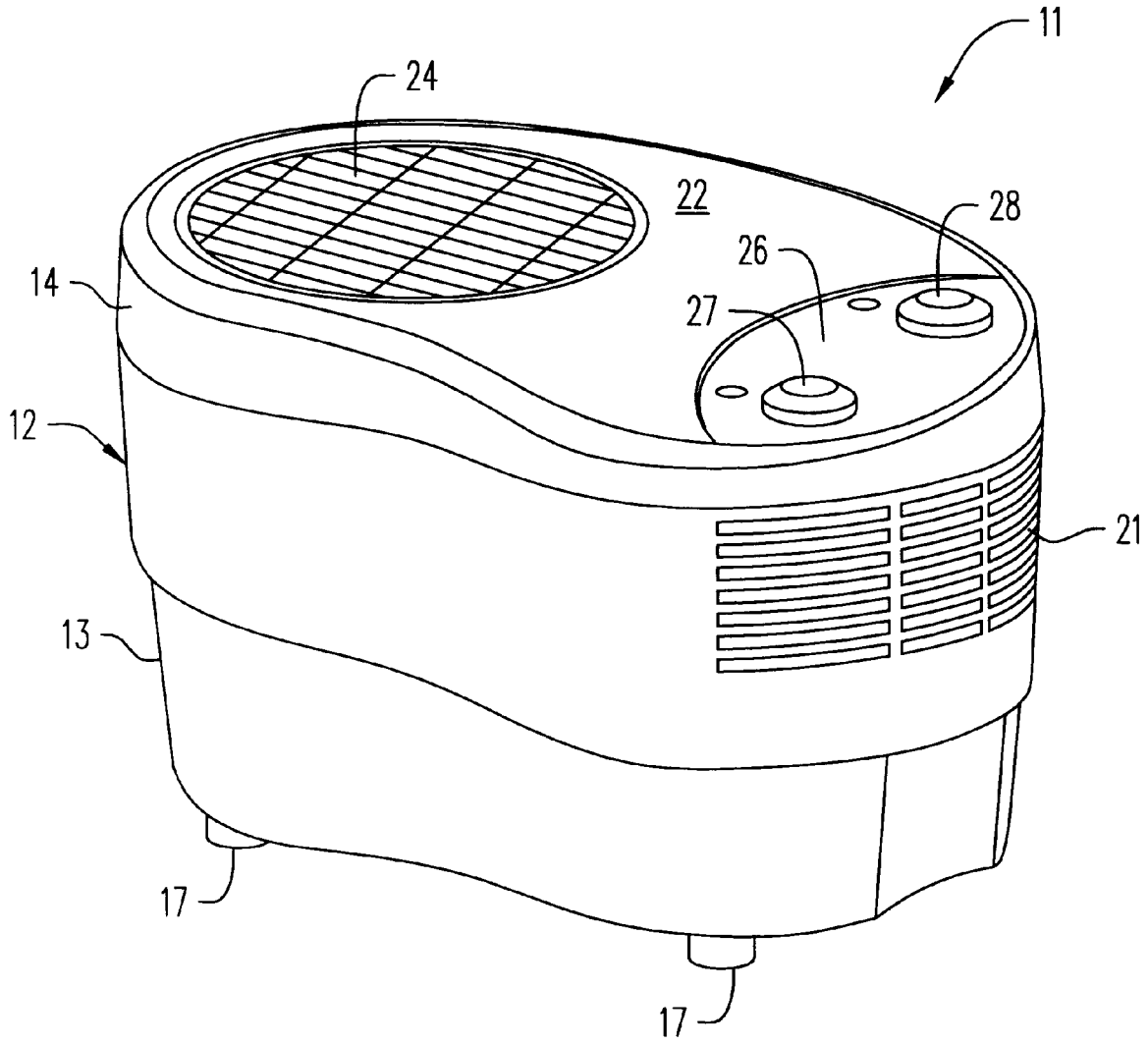
FIG. 1 is a perspective view of a portable humidifier according to the invention.
Figure 2:
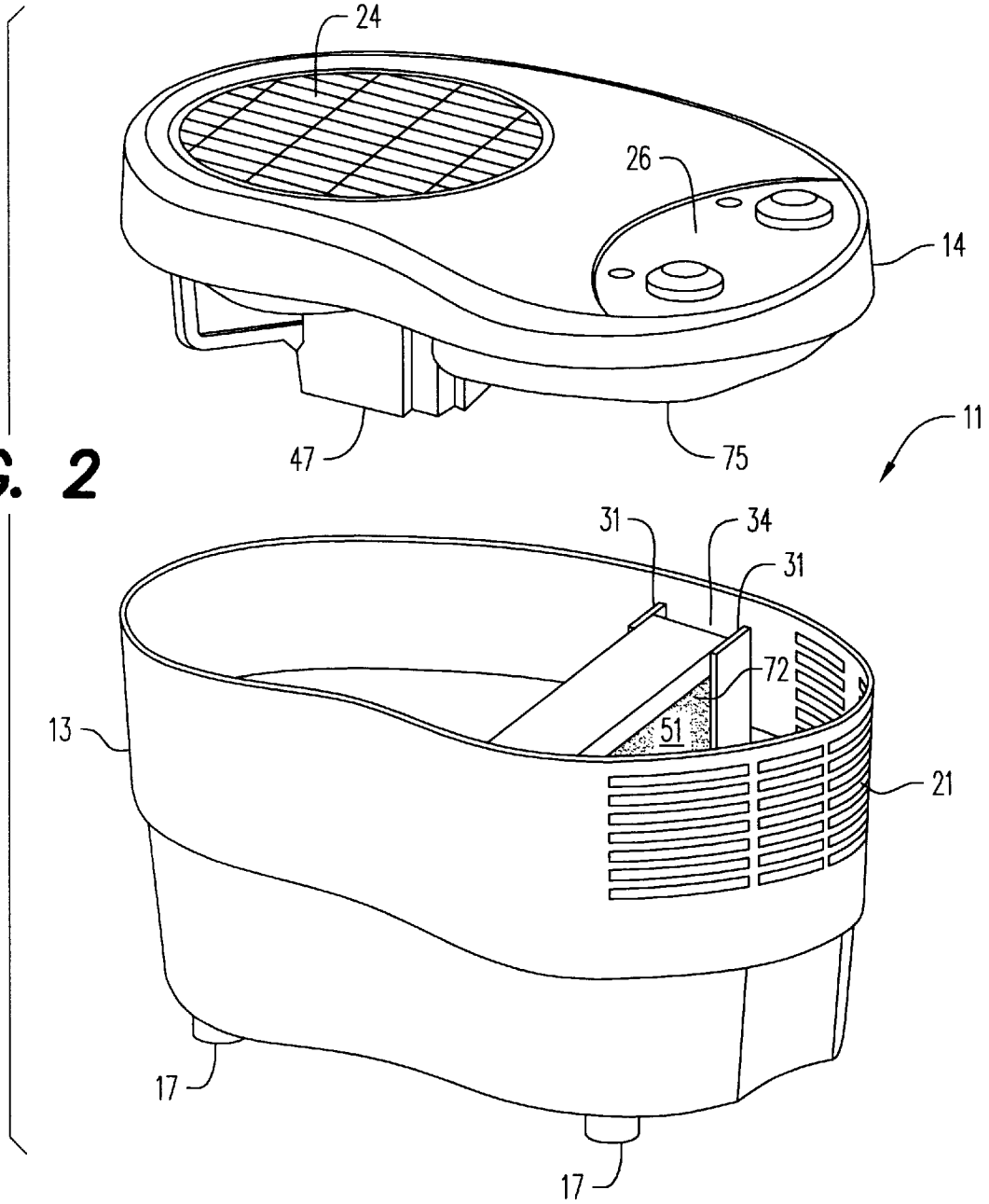
FIG. 2 is an exploded view of the humidifier shown in FIG. 1.

A portable humidifier 11 includes a housing 12 formed by a base 13 and a cover 14. The base 13 is supported by legs 17 and has a bottom portion which defines a liquid supply reservoir 18. Also defined in a side wall of the base 13 is an air outlet 21. The top wall 22 of the cover 14 forms an air inlet 24 which communicates with the air outlet 21 via an air flow path defined by the housing 12. Retained by the top wall 22 is a control panel 26 having control knobs 27, 28 for operating the humidifier 11.

Figure 3:
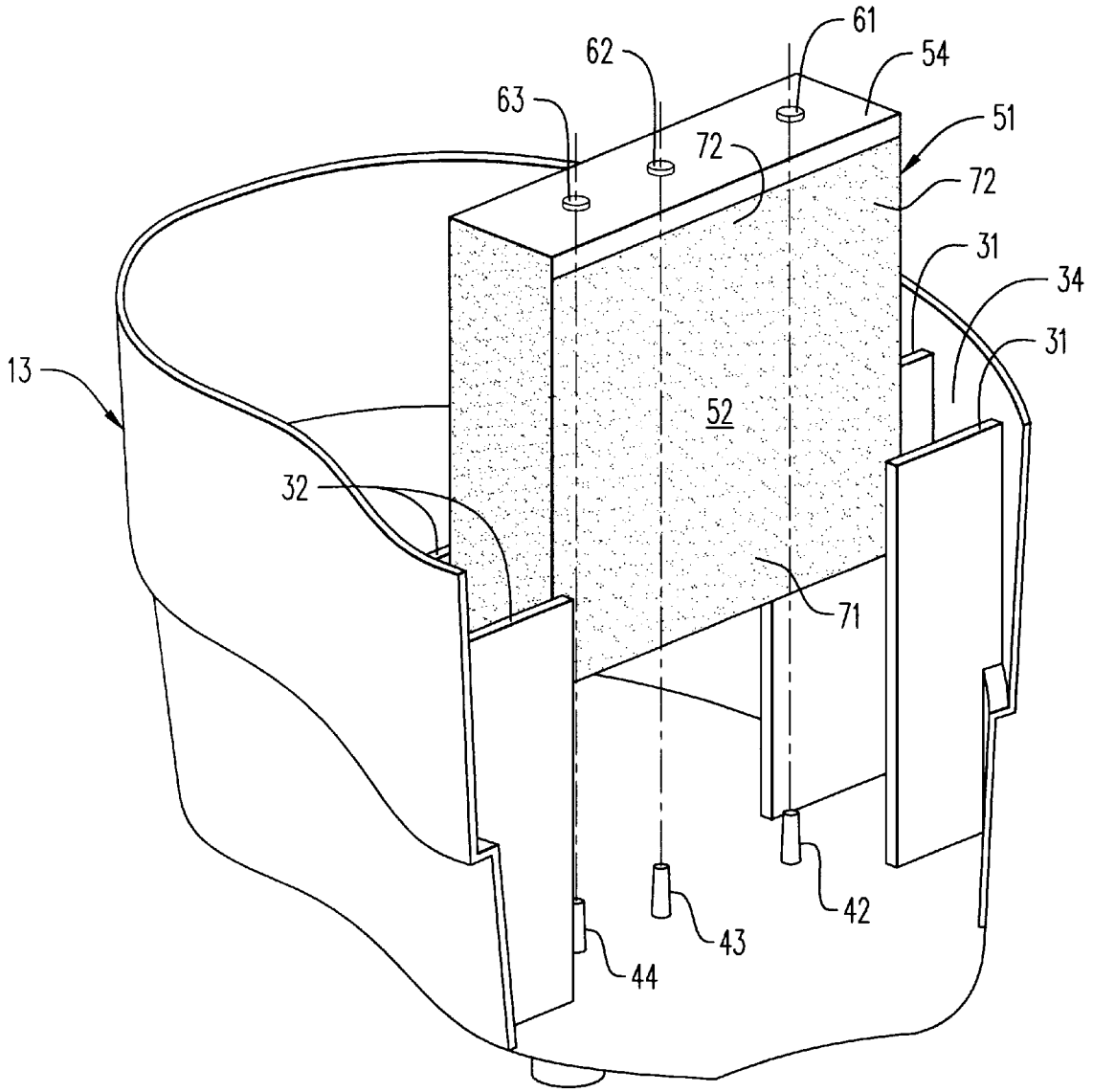
FIG. 3 is a partially cut away perspective view of a base portion of the humidifier shown in FIGS. 1 and 2.
Figure 5:
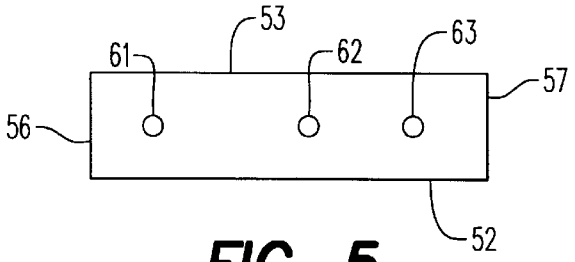
FIG. 5 is a top view of the cartridge element shown in FIG. 4.
Figure 7:
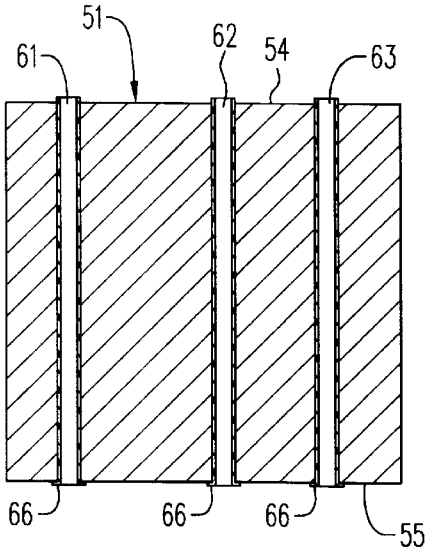
FIG. 7 is a cross sectional view taken along lines 7—7 of FIG. 6.
Figure 4:
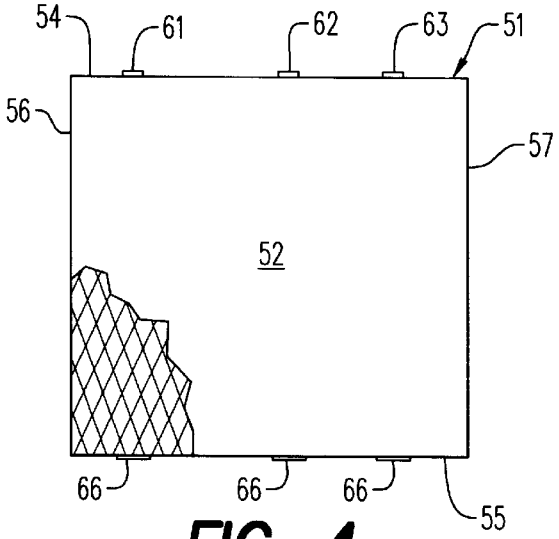
FIG. 4 is an elevational view of a liquid absorbent cartridge element used in the humidifier of FIGS. 1–3.
Figure 6:
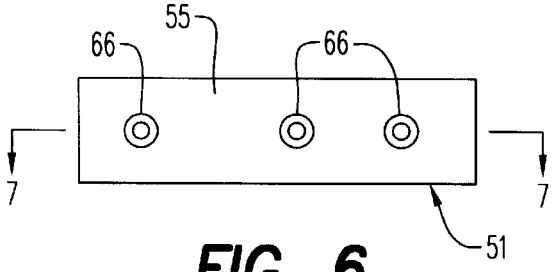
FIG. 6 is a bottom view of the cartridge element shown in FIG. 4.

As illustrated in FIG. 3, oppositely facing inner walls of the base 13 have inwardly extending, vertical pairs of spaced apart walls 31, 32 which form channels 34. the walls 31 and 32 are aligned and spaced apart forming a vertical slot 36 which extends into the reservoir 18. Projecting upwardly into the slot 36 from a bottom wall 41 of the base 13 are three retainer key fingers 42–44. As shown, the fingers 42–44 are arranged in a rectilinear array aligned with the slot 36 and rendered asymmetrical by a larger horizontal spacing between the fingers 42 and 43 than between the fingers 43 and 44. A replaceable, air permeable, liquid absorbent cartridge element 5l is replaceably retained in the base 13 by the fingers 42–44. Mounted on the cover 14 is an electrically energized blower 47 which can be activated to produce air flow through the air flow path extending between the air inlet 24 and the air outlet 21.

As shown in FIGS. 4–7, the cartridge element 51 is a block having a front surface 52, a rear surface 53, a top surface 54, a bottom surface 55 and side surfaces 56, 57. Extending vertically through the cartridge element 51 between the top and bottom surfaces 54, 55 are a plurality of embedded hollow sleeves 61–63. A transverse collar portion 66 at one end of each sleeve 61–63 engages the bottom surface 55 of the cartridge element 51. The sleeves 61–63 are spaced apart horizontally in a parallel asymmetrical rectilinear array with the spacing between the sleeves 62 and 63 being less than the spacing between the sleeves 61 and 62. The asymmetrical array provided by the sleeves 61–63 is mated to that provided by the fingers 42–44 so as to facilitate insertion of the fingers 42–44 into, respectively, the sleeves 61–63. With the key retainer fingers 42–44 pressed into the keyhole sleeve recesses 61–63, one portion 71 of the cartridge element 51 is located in the reservoir 18 of the base 13 while another portion 72 is disposed in the air flow path between the air inlet 24 and the air outlet 21.

Prior to use of the humidifier 11, the cover 14 is removed and the reservoir 18 in the base 13 filled with water from a suitable tap. The cover 14 then is replaced on the base 13 and a closure projection 75 engages top edges of the walls 31, 32 and the top surface 54 of the cartridge element 51 to establish between the air inlet 24 and the air outlet 21 an air flow path which includes another portion 72 of the cartridge element 51. Water in the reservoir 18 saturates the one portion 71 of the cartridge element 51 and moves upwardly by capillary action to also saturate the upper above portion 72 of the element 51. After activation of the humidifier 11 by manipulation of the knobs 27, 28, the blower 47 is activated to produce between the inlet 24 and outlet 21 air flow which entrains water in the upper portion 72 of the cartridge element 51 and thereby supplies moisture to the environment surrounding the humidifier 11.

After a certain operating period, the cartridge element 51 will become clogged with dirt particles carried by the air flow between the air inlet 24 and outlet 21. Consequently, air flow is reduced and the operating efficiency of the humidifier 11 significantly diminished. At that time, the clogged cartridge element 51 is removed from the humidifier 11 and replaced by a replacement element. Because of the keying arrangement provided by the key retainer fingers 42–44 and the keyhole recess sleeves 61–63, the base 13 will accommodate only a mated cartridge element 51 having operating characteristics that maximize the operating efficiency of the humidifier 11. Consequently, diminution of operating efficiency caused by use of an inferior cartridge element is prevented.

Obviously, many modifications and variations of the present invention are possible in light of the above teachings. It is to be understood, therefore, that the invention can be practiced otherwise than as specifically described.

What is claimed is:

1. A portable humidifier comprising:

housing means defining an air inlet, an air outlet, and an air flow path between said air inlet and said air outlet;

retainer means disposed in said housing means and defining key means defining a plurality of projections spaced apart in an asymmetrical array;

an air permeable, liquid absorbent cartridge element replaceably retained by said retainer means and defining keyhole means comprising a plurality of recesses, each disposed to receive one of said projections; at least one portion of said cartridge element being disposed in said air flow path;

a blower disposed in said housing means and activatable to produce air flow through said air flow path and said cartridge element; and liquid supply means for supplying liquid to said portion of said cartridge element.

2. A portable humidifier according to claim 1 wherein said keyhole means comprises a plurality of parallel sleeves embedded in said cartridge element and defining said recesses.

3. A portable humidifier according to claim 2 wherein said projections are substantially vertical fingers projecting into said housing means.

4. A portable humidifier according to claim 3 wherein each of said sleeves extends substantially vertically into said cartridge element and has at one end a collar portion engaging an outer surface thereof.

5. A portable humidifier according to claim 1 wherein said liquid supply means is a liquid reservoir defined by said housing means, and another portion of said cartridge element is disposed in said reservoir.

6. A portable humidifier according to claim 5 wherein said keyhole means comprises a plurality of parallel sleeves embedded in said cartridge element and defining said recesses.

7. A portable humidifier according to claim 6 wherein said projections are substantially vertical fingers projecting into said housing means.

8. A portable humidifier according to claim 7 wherein each of said sleeves extends substantially vertically into said cartridge element and has at one end a collar portion engaging an outer surface thereof.

9. A replaceable air permeable, liquid absorbent cartridge element for use in a portable humidifier having a key means defining retainer means for receiving said cartridge element said cartridge element defining keyhole means defining a plurality of asymmetrically spaced apart recesses for receiving said key means.

10. A replaceable air permeable, liquid absorbent cartridge element according to claim 9 wherein each of said recesses is formed by a sleeve embedded in said cartridge element.

11. A replaceable air permeable, liquid absorbent cartridge element according to claim 10 wherein said sleeves are disposed in a substantially parallel array.

12. A replaceable air permeable, liquid absorbent cartridge element according to claim 11 wherein each said sleeve has at one end a collar engaging an outer surface of said cartridge element.

* * * * *